US008120896B2

(12) United States Patent
Mori et al.

(10) Patent No.: US 8,120,896 B2
(45) Date of Patent: Feb. 21, 2012

(54) STRAP DEVICE AND ELECTRONIC APPARATUS INCLUDING THE SAME

(75) Inventors: Takeshi Mori, Osaka (JP); Hirofumi Takemasa, Kyoto (JP)

(73) Assignee: Panasonic Corporation, Osaka (JP)

( * ) Notice: Subject to any disclaimer, the term of this patent is extended or adjusted under 35 U.S.C. 154(b) by 295 days.

(21) Appl. No.: 12/393,350

(22) Filed: Feb. 26, 2009

(65) Prior Publication Data

US 2009/0219677 A1 Sep. 3, 2009

(30) Foreign Application Priority Data

Feb. 28, 2008 (JP) ..... 2008-048472

(51) Int. Cl.

| | |
|---|---|
| ***H05K 5/00*** | (2006.01) |
| ***H05K 7/00*** | (2006.01) |
| ***A45C 3/00*** | (2006.01) |
| ***B65D 85/00*** | (2006.01) |
| ***B65D 69/00*** | (2006.01) |
| ***B65D 71/00*** | (2006.01) |
| ***B65D 25/54*** | (2006.01) |

(52) U.S. Cl. ..... 361/679.03; 361/679.55; 361/679.56; 190/110; 206/576; 206/320; 206/769; 206/771

(58) Field of Classification Search ..... 361/679.03, 361/679.55, 679.56; 190/110; 206/576, 206/320, 769, 771

See application file for complete search history.

(56) References Cited

U.S. PATENT DOCUMENTS

| | | | | |
|---|---|---|---|---|
| 4,424,841 | A * | 1/1984 | Smith | 224/240 |
| 6,301,101 | B1 * | 10/2001 | Anzai et al. | 361/679.3 |
| 6,942,400 | B2 | 9/2005 | Shibayama | |
| 7,359,184 | B2 * | 4/2008 | Lord | 361/679.55 |
| 2002/0197073 | A1 | 12/2002 | Shibayama | |
| 2007/0201201 | A1 * | 8/2007 | Daley | 361/683 |

FOREIGN PATENT DOCUMENTS

| | | |
|---|---|---|
| JP | 3011677 | 3/1995 |
| JP | 8-123417 | 5/1996 |
| JP | 3058227 | 3/1999 |
| JP | 2000-105630 | 4/2000 |
| JP | 2003-008961 | 1/2003 |
| JP | 2004-030463 | 1/2004 |
| JP | 2006-307918 | 11/2006 |
| JP | 2007-102532 | 4/2007 |

* cited by examiner

*Primary Examiner* — Anthony Haughton

(74) *Attorney, Agent, or Firm* — Hamre, Schumann, Mueller & Larson, P.C.

(57) ABSTRACT

The present invention provides a strap device capable of, when used in a state of being attached to an electronic apparatus body including a display portion and a key input portion as an object, improving the visibility of the display portion and the operability of the key input portion and the touch panel without tilting the electronic apparatus body with the wrist. A strap device includes a substantially plate-shaped belt base to be attached to the object; and a strap belt formed in an annular shape and supported by a substantially center portion of the belt base rotatably within a plane substantially parallel to the belt base. The belt base includes a back part provided with a pivot fitting as a bearing member for supporting the strap belt rotatably and a front part facing the back part. The strap belt extends across the belt base from the front part to the back part of the belt base.

9 Claims, 10 Drawing Sheets

STRAP DEVICE AND ELECTRONIC APPARATUS INCLUDING THE SAME

BACKGROUND OF THE INVENTION

1. Field of the Invention

The present invention relates to a strap device used in a state of being attached to an electronic apparatus such as a notebook personal computer (PC) or a personal digital assistant (PDA) as an object, and an electronic apparatus including the strap device.

2. Description of Related Art

Electronic apparatuses with excellent portability, such as a notebook PC and a PDA, have been used commonly in recent years, and many of them are equipped with a strap device in order to improve their portability (see Patent documents 1 and 2, for example).

Patent document 1 discloses a notebook PC equipped with a holding portion (hand strap), such as a fixing belt for fixing a hand for holding the notebook PC body, on its undersurface (back). According to the configuration disclosed in Patent document 1, the notebook PC can be operated with a right hand while holding the notebook PC body with the palm of a left hand placed through the hand strap. It should be noted that, in this case, the hand strap is attached to the notebook PC along a longitudinal direction of a display portion (display) or a key input portion (keyboard) of the notebook PC.

Patent document 2 discloses a notebook PC having the configuration of Patent document 1, whose hand strap can be adjusted in accordance with the size of a user's hand.

Patent document 1: JP 2000-105630 A (claim 3, FIGS. 1 to 3)

Patent document 2: JP 2007-102532 A (claims 1 and 2, FIG. 1)

SUMMARY OF THE INVENTION

In Patent documents 1 and 2, however, each of the hand straps is attached to the notebook PC along the longitudinal direction of the display portion or the key input portion. Thus, the visual direction of the display portion and the layout direction of input keys of the key input portion of the notebook PC become orthogonal to the direction of the fingers of the hand placed through the hand strap, thereby resulting in poor visibility of the display portion and poor operability of the key input portion and the touch panel. That is, when the notebook PC body is held normally, the visible direction of the display portion and the layout direction of input keys of the key input portion tilt. Thus, in actual use, the notebook PC body needs to be tilted with the wrist in order to improve the visibility of the display portion and the operability of the key input portion and the touch panel, which leads to wrist fatigue.

With the foregoing in mind, it is an object of the present invention to provide a strap device capable of, when used in a state of being attached to an electronic apparatus body including a display portion and a key input portion as an object, improving the visibility of the display portion and the operability of the key input portion and the touch panel without tilting the electronic apparatus with the wrist; and an electronic apparatus equipped with the strap device.

In order to attain the above object, the strap device of the present invention includes a substantially plate-shaped belt base to be attached to an object; and a strap belt formed in an annular shape and supported by a substantially center portion of the belt base rotatably within a plane substantially parallel to the belt base.

According to the configuration of the strap device, the annular strap belt, through which the palm of a hand is placed, is supported rotatably by the substantially center portion of the belt base attached to the object within a plane substantially parallel to the belt base. Thus, when the strap device is used in a state of being attached to an electronic apparatus body including a display portion and a key input portion as the object, the visibility of the display portion and the operability of the key input portion and the touch panel can be improved by rotating the electronic apparatus body without having to tilt the electronic apparatus body with the wrist. As a result, the wrist does not get tired even if the electronic apparatus body is used for long hours. Further, since the strap belt can be rotated clockwise and counterclockwise with respect to the belt base (object), both a right-handed user and a left-handed user can obtain similar effects by using the strap device.

In the configuration of the strap device of the present invention, it is preferable that the strap belt projects beyond each of opposing left and right outer edges of the belt base, and a notch is formed on at least either of upper and lower outer edges of the base belt coupling the left and the right outer edges from which the strap belt projects. According to this preferred example, it is possible to allow the rotation movement of the strap belt with respect to the belt base. Further, when the strap device is used in a state of being attached to an electronic apparatus body as an object provided with a camera or the like on its backside, it is possible to prevent the camera or the like from being hidden by the belt base. In this case, it is preferable that a concave notch is formed on each of the left and the right outer edges of the belt base. According to this preferred example, the rotation movement of the strap belt with respect to the belt base can be allowed while the strap belt can be downsized.

Further, in the configuration of the strap device of the present invention, it is preferable that the belt base is composed of a back part provided with a bearing member for supporting the strap belt rotatably, and a front part facing the back part, the strap belt striding over the belt base from the front part to the back part. According to this preferred example, since a part of the annular strap belt positioned on the back side of the belt base is pressed by the belt base when the strap device is attached to the object, the shape of the strap belt can be stabilized. Further, in this case, it is preferable that a protrusion, which protrudes toward the strap belt side, is provided at a substantially center portion of the front part of the belt base. In this case, it is further preferable that the protrusion is rounded. According to these preferred examples, when the electronic apparatus body as the object is held with the palm by placing the palm into the strap belt, the protrusion fits into the dinted portion of the palm, thereby allowing a user to hold the electronic apparatus body easily without exerting extra force. Thus, the electronic apparatus body can be used comfortably.

Further, in the configuration of the strap device of the present invention, it is preferable that each corner portion of the outer edges of the belt base is provided with an attachment member for attaching the belt base to the object. In this case, it is preferable that the attachment members provided at at least either a pair of upper left and upper right corner portions or a pair of lower left and lower right corner portions are attachable to and detachable from the object. According to these preferred examples, when the strap device is used in a state of being attached to, for example, an electronic apparatus body as an object that has on its back side battery packs including lids that can be removed when replacing batteries, the batteries can be replaced easily by detaching either the pair of upper left and upper right corner portions or the pair of lower left and lower right corner portions from the electronic apparatus body.

The electronic apparatus of the present invention includes: an electronic apparatus body including a first enclosure including a control portion for controlling a display signal to be displayed on a display portion, a circuit board equipped with a signal processing circuit for processing an input signal received from the control portion and/or a display signal to be displayed on the display portion, and a second enclosure containing the circuit board and forming a housing together with the first enclosure; and the strap device according to the present invention attached to the second enclosure. Here, the "control portion" is a concept that includes a key input portion for inputting an information signal to be converted into a display signal, scroll buttons for controlling the location, the size, and the like of a region of the display portion in which a display signal is displayed, operation buttons for changing or identifying a location within the display portion in which keys are entered, and the like.

According to the configuration of the electronic apparatus of the present invention, it is possible to obtain not only the effects as described above such as improving the visibility of the display portion and the operability of the key input portion and the touch panel, but also the following effects. That is, as described above, since the electronic apparatus of the present invention is easy to hold and has excellent operability, it is possible to reduce the chances of the electronic apparatus body held with the palm placed through the strap belt being dropped. Consequently, it is possible to reduce breakdown of the electronic apparatus body or to reduce the chances of the user himself or people in the surroundings being injured as a result of dropping the electronic apparatus body. Furthermore, a notebook PC body as an electronic apparatus body is designed generally on the basis of the premise that it is operated while being placed on a table or the like. Thus, the notebook PC body is configured such that heat generated therein is radiated from its back side, which faces the table or the like. Thus, when the notebook PC body is operated with one hand by attaching the strap device to the notebook PC and holding the notebook PC body with the other hand, it is possible to reduce transfer of the heat generated in the notebook PC body to the palm of the hand holding the notebook PC since the belt base is provided between the palm holding the notebook PC body and the back of the notebook PC body.

Further, in the configuration of the electronic apparatus of the present invention, it is preferable that the display portion and the control portion are provided in the same plane of the first enclosure.

According to the present invention, it is possible to provide a strap device capable of, when used in a state of being attached to an electronic apparatus body including a display portion and a key input portion as the object, improving the visibility of the display portion and the operability of the key input portion and the touch panel without tilting the electronic apparatus body with the wrist; and an electronic apparatus equipped with the strap device.

DESCRIPTION OF THE INVENTION

Hereinafter, the present invention will be described in detail by way of illustrative embodiments with reference to the drawings.

Embodiment 1

The strap device of the present invention is used in a state of being attached to an electronic apparatus body, such as a notebook PC or a PDA. First, a strap device used in a state of being attached to a notebook PC as an electronic apparatus body will be described.

Strap Device

Figure 1:
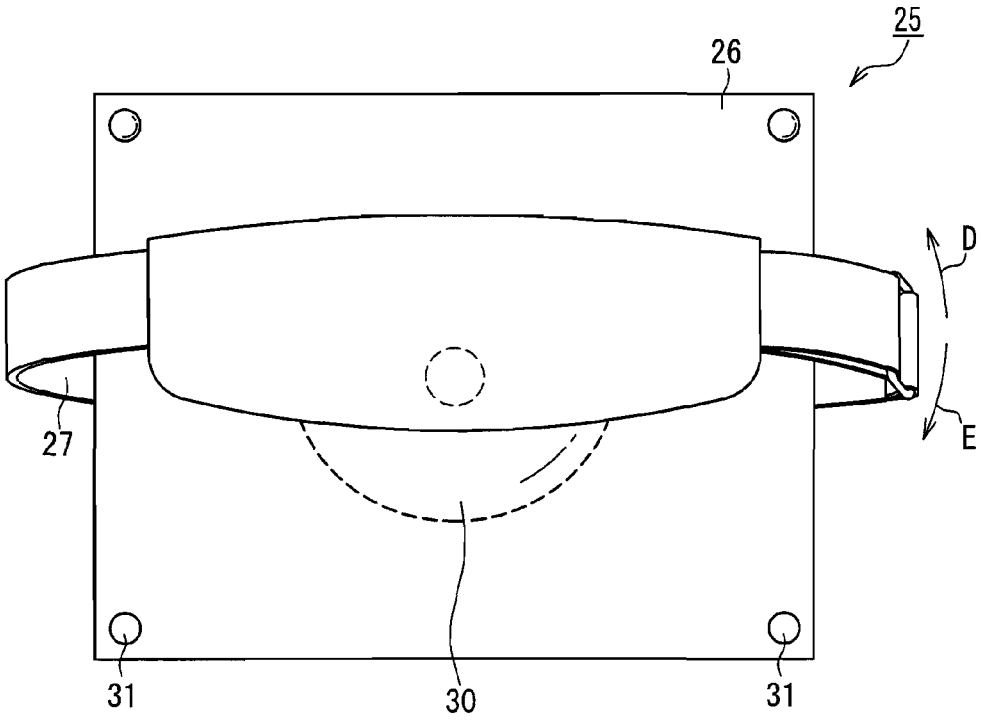
FIG. 1 is a front view showing a strap device according to Embodiment 1 of the present invention.
Figure 2:
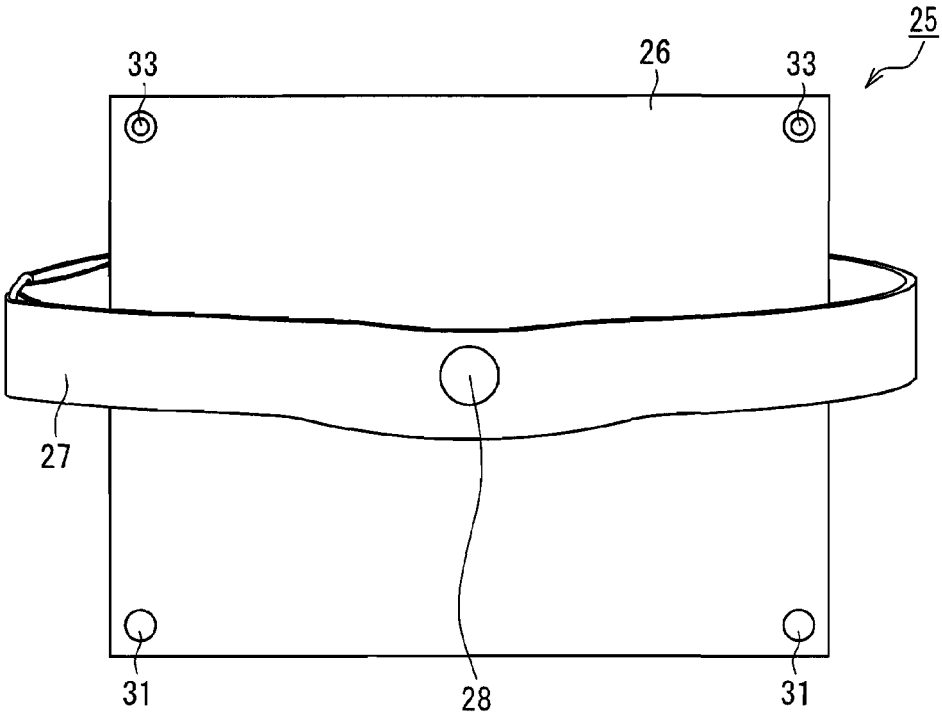
FIG. 2 is a back view showing the strap device according to Embodiment 1 of the present invention.
Figure 3:
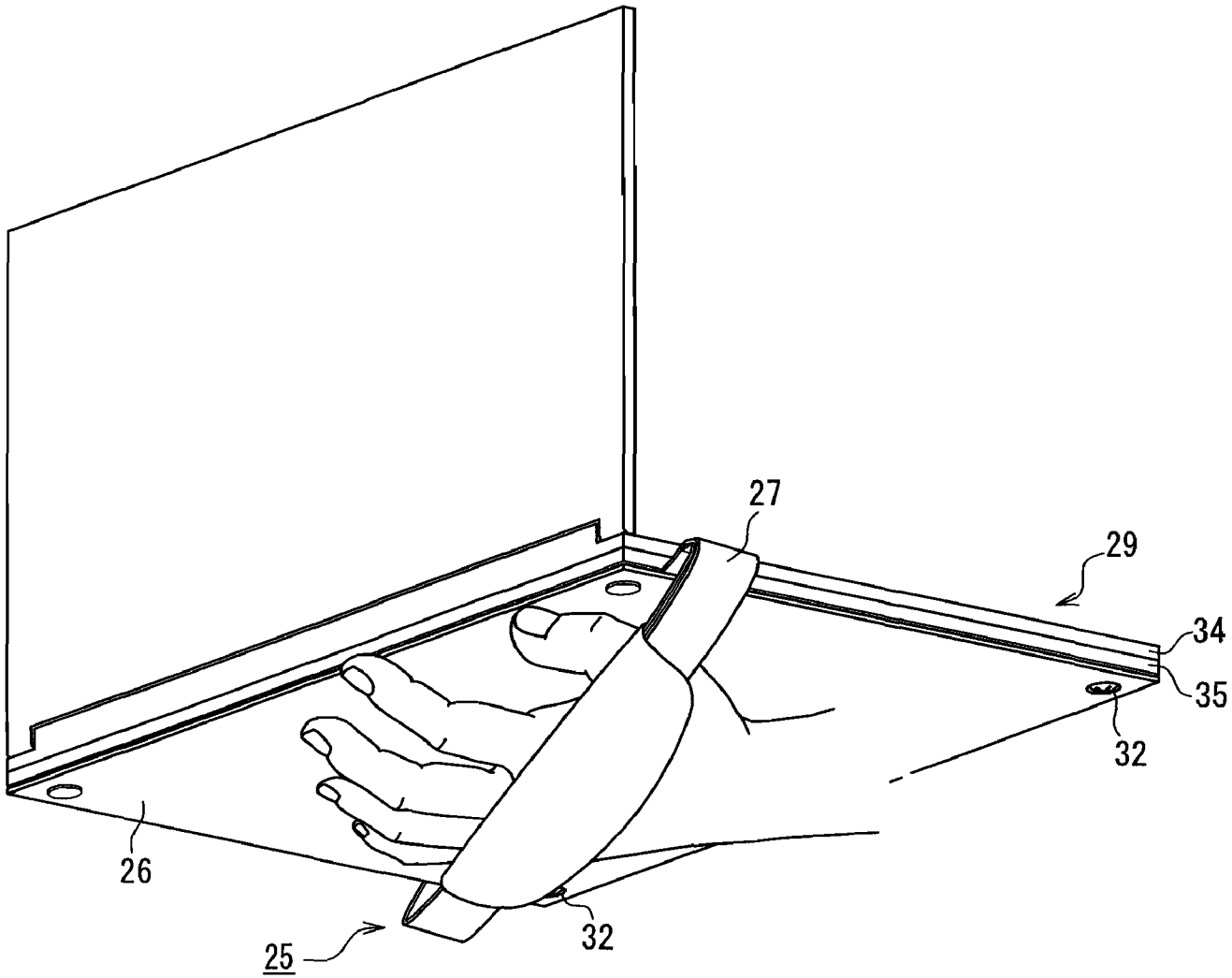
FIG. 3 is a perspective view showing a condition of use of a notebook PC equipped with the strap device according to Embodiment 1 of the present invention from the back side.

FIG. 1 is a front view showing a strap device according to Embodiment 1 of the present invention. FIG. 2 is a back view showing the strap device according to Embodiment 1 of the present invention. FIG. 3 is a perspective view showing a condition of use of a notebook PC body equipped with the strap device according to Embodiment 1 of the present invention from the back side.

As shown in FIGS. 1 and 2, a strap device 25 according to the present embodiment includes: a belt base 26 formed in a substantially rectangular and plate shape, which is to be attached to an object; and a strap belt 27 formed in an annular shape and supported by a substantially center portion of the belt base 26 rotatably within a plane substantially parallel to the belt base 26. Here, the belt base 26 is composed of a back part provided with a pivot fitting 28 as a bearing member for supporting the strap belt 27 rotatably, and a front part facing the back part. The strap belt 27 extends across the belt base 26 from the front part to the back part of the belt base 26. Since the strap device 25 has such a configuration, a part of the annular strap belt 27 positioned on the back part side of the belt base 26 is pressed by the belt base 26 when the strap device 25 is attached to the back of a notebook PC body 29 as an object (see FIG. 3), and the shape of the strap belt 27 can be stabilized. The strap belt 27 can be rotated about plus or minus 20° from the state shown in FIG. 1 (see arrows D and E in FIG. 1).

Further, the strap belt 27 projects beyond each of opposing left and right outer edges of the belt base 26, thereby allowing the rotation movement of the strap belt 27 with respect to the belt base 26. It should be noted that the size of the strap belt 27 can be changed in accordance with the size of a user's hand (see descriptions in Embodiment 2).

A protrusion 30, which protrudes toward the strap belt 27 side, is provided at a substantially center portion of the front part of the belt base 26. Thus, when holding the notebook PC body 29 as an object with a palm by placing the palm into the strap belt 27 (see FIG. 3), heat radiated from the back of the notebook PC body 29 is less likely to transfer to the palm. It is preferable that the protrusion 30 is rounded.

The belt base 26 is provided with screw insertion holes 31 as attachment members at a pair of lower left and lower right corner portions. Thus, the strap device 25 can be attached to the back of the notebook PC body 29 by placing the screw insertion holes 31 of the belt base 26 over screw holes (not shown) at a pair of lower left and lower right corner portions of the back of the notebook PC body 29, and fixing the strap device 25 to the notebook PC body 29 with screws 32 (see FIG. 3). Further, the belt base 26 is provided with male hooks 33 as attachment members at a pair of upper left and upper right corner portions of the back part. Thus, when attaching the strap device 25 to the back of the notebook PC body 29, the male hooks 33 of the belt base 26 can be latched to female hooks (not shown) provided respectively at a pair of upper left and upper right corner portions of the back of the notebook PC body 29 (see FIG. 3). A battery of the notebook PC body 29 is placed on the upper side of the keyboard. By configuring the attachment members provided at the pair of upper left and upper right corner portions of the belt base 26 to be attachable to and detachable from the notebook PC body 29, the battery of the notebook PC body 29 can be replaced easily by detaching the pair of upper left and upper right corner portions of the belt base 26 from the notebook PC body 29.

The Use of the Strap Device and the Electronic Apparatus Body Equipped with the Strap Device Next, the use of the strap device and the electronic apparatus body equipped with the strap device according to the present embodiment will be described.

As shown in FIG. 3, the notebook PC body 29 includes: a first front-side enclosure 34 including a control portion for controlling a display signal to be displayed on a liquid crystal (LC) display portion; a circuit board (not shown) equipped with a signal processing circuit for processing an input signal received from the control portion and/or a display signal to be displayed on the liquid crystal display portion; and a second back-side enclosure 35 containing the circuit board and forming a housing together with the first enclosure 34. Here, the "control portion" includes a key input portion for inputting an information signal to be converted into a display signal, scroll buttons for controlling the location, the size, and the like of a region of the liquid crystal display portion in which a display signal is displayed, operation buttons for changing or identifying a location within the liquid crystal display portion in which keys are entered, and the like.

The strap device 25 according to the present embodiment is used in a state of being attached to the back side of the notebook PC body 29 as an electronic apparatus body. The strap device 25 may be attached to the notebook PC body 29 as follows. First, the screw insertion holes 31 at the pair of lower left and lower right corner portions of the belt base 26 are placed over the screw holes on the pair of lower left and lower right corner portions of the back of the notebook PC body 29 and the strap device 25 is fixed to the notebook PC body 29 with the screws 32. Next, the male hooks 33 at the pair of upper left and upper right corner portions of the belt base 26 are latched to the female hooks on the pair of upper left and upper right corner portions of the back of the notebook PC body 29. After attaching the strap device 25 to the notebook PC body 29 in the above manner, the palm of the left hand is placed through the strap belt 27, so that the notebook PC body 29 is held with the palm of the left hand while key operation is performed with the right hand. In this case, since the strap belt 27, through which the palm of the left hand is placed, is supported by the substantially center portion of the belt base 26 attached to the notebook PC body 29 rotatably within a plane substantially parallel to the belt base 26, the visibility of the display portion (display) and the operability of the key input portion (keyboard) can be improved by rotating the notebook PC body 29 without having to tilt the notebook PC body 29 with the wrist. As a result, even if the notebook PC body 29 is used for long hours by holding it with the left hand, the wrist does not get tired. Further, since the strap belt 27 can be rotated clockwise and counterclockwise with respect to the belt base 26 (the notebook PC body 29), both a right-handed user and a left-handed user can obtain similar effects by using the strap device 25. Furthermore, the notebook PC body 29 is designed generally on the premise that it is operated while being placed on a table or the like. Thus, the notebook PC body 29 is configured such that heat generated therein is radiated from its back side, which faces the table or the like. Thus, when the notebook body PC 29 is operated with one hand by attaching the strap device 25 to the notebook PC body 29 and holding the notebook PC body 29 with the other hand, it is possible to reduce by the belt base 26 transfer of the heat generated in the notebook PC body 29 to the palm through the back of the notebook PC body 29. The transfer of the heat to the palm can be reduced further by providing the protrusion 30 on the belt base 26.

In the strap device 25 according to the present embodiment, the protrusion 30, which protrudes toward the strap belt 27 side, is provided at the substantially center portion of the front part of the belt base 26. However, the protrusion 30 is not an absolute necessity.

Further, in the strap device 25 according to the present embodiment, the belt base 26 is composed of the back part provided with the pivot fitting 28 as a bearing member for supporting the strap belt 27 rotatably; and the front part facing the back part, and the strap belt 27 extends across the belt base 26 from the front part to the back part of the belt base 26. However, the strap device 25 is not necessarily limited to such a configuration. For example, the annular strap belt may be placed on the front side of the belt base and may be supported by the front side of the belt base.

Further, in the strap device 25 according to the present embodiment, only the attachment members on the pair of upper left and upper right corner portions of the belt base 26 are attachable to and detachable from the object (the notebook PC body 29). It is useful for the attachment members on at least either the pair of upper left and upper right corner portions or the pair of lower left and lower right corner portions of the belt base to be attachable to and detachable from the object. However, when battery replacement or the like is not needed, none of the attachment members on the corner portions of the belt may need to be attachable to and detachable from the object.

Embodiment 2

Electronic Apparatus Body

A strap device according to the present embodiment is used in a state of being attached to, in particular, a PDA-type electronic apparatus body. First, an example of a PDA-type electronic apparatus body will be described.

Figure 11:
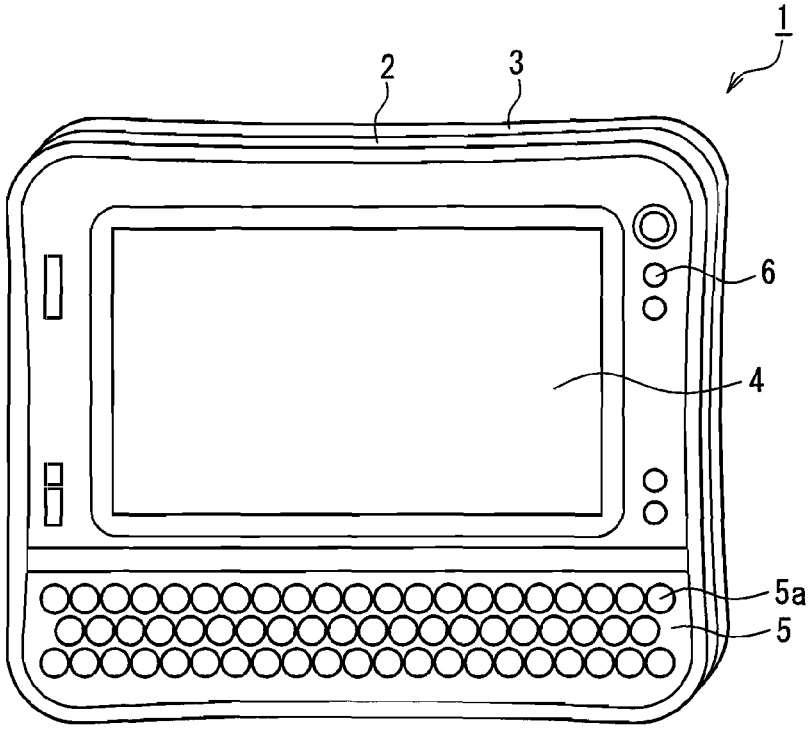
FIG. 11 is a perspective view showing the front of the electronic apparatus body according to Embodiment 2 of the present invention.
Figure 12:
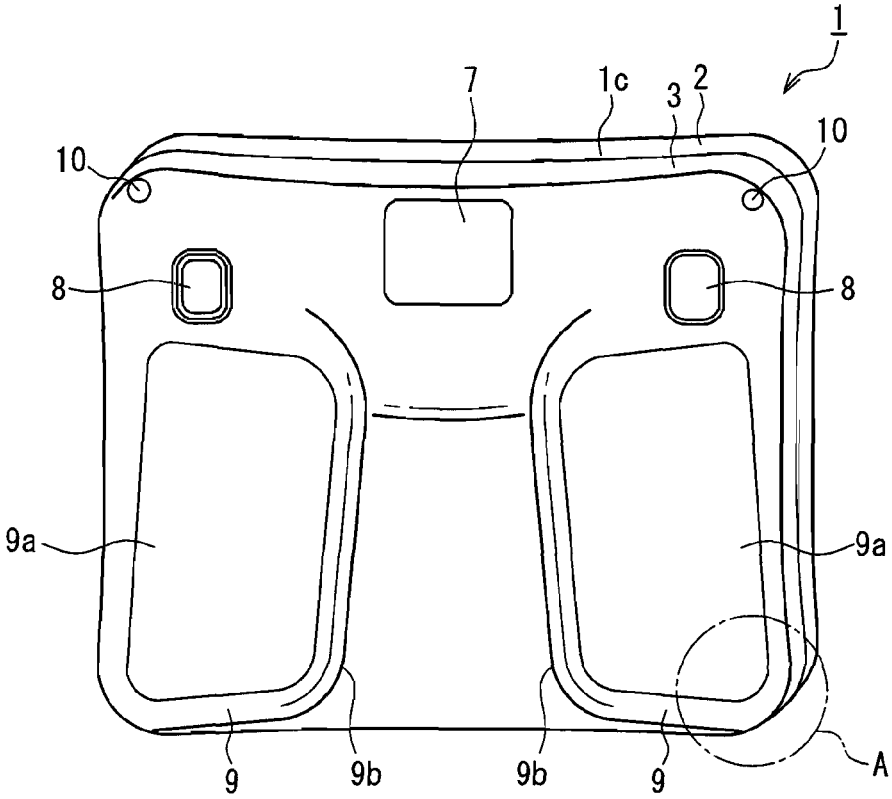
FIG. 12 is a perspective view showing the back of the electronic apparatus body according to Embodiment 2 of the present invention.
Figure 13:
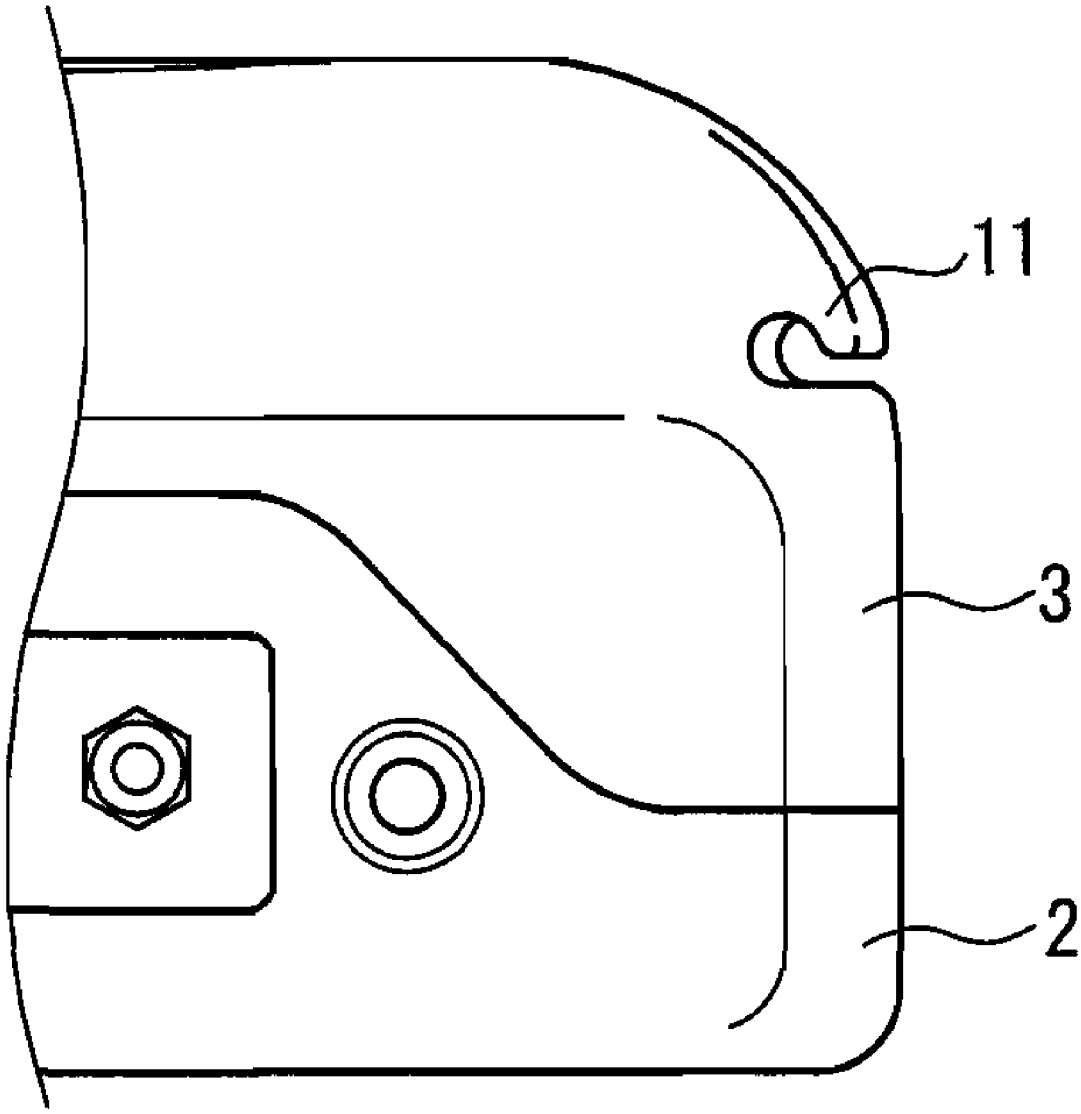
FIG. 13 is an enlarged perspective view showing the portion A shown in FIG. 12.

FIG. 11 is a perspective view showing the front side of the electronic apparatus body according to Embodiment 2 of the present invention. FIG. 12 is a perspective view showing the back side of the electronic apparatus body according to Embodiment 2 of the present invention. FIG. 13 is an enlarged perspective view showing the portion A shown in FIG. 12.

As shown in FIGS. 11 and 12, an electronic apparatus body 1 according to the present embodiment includes a first front-side enclosure 2, a circuit board, which will be described later, and a second back-side enclosure 3 containing the circuit board and forming a housing together with the first enclosure 2.

As shown in FIG. 11, the first enclosure 2 includes, in the same surface (front surface), a liquid crystal (LC) display portion 4 having a rectangular outer shape for displaying visible information converted from an information signal; a key input portion 5 composed of a plurality of first input keys 5*a* arranged in a plurality of lines along the lower longer side of the liquid crystal display portion 4; and auxiliary keys 6 disposed on the right side with respect to the liquid crystal display portion 4 for assisting an input operation performed by operating the plurality of first input keys 5*a*.

As shown in FIG. 12, the second enclosure 3 includes a camera 7 provided at an upper center portion of the enclosure, and elliptic trigger buttons (second input keys) 8 disposed respectively on both the right and the left sides with respect to the camera 7 for functioning as trigger switches for a barcode reader. Further, the second enclosure 3 is provided with battery packs 9 on both the left and the right sides thereof. Each of the battery packs 9 includes a lid 9*a* that can be removed when replacing a battery (not shown). Opposing edge portions 9*b* of the pair of left and right battery packs 9 are portions with which the tips of fingers except thumbs come into contact when holding and operating the electronic apparatus body 1 with both hands. Further, screw holes 10 are formed respectively on a pair of upper left and upper right corner portions of the second enclosure 3. Thus, a pair of upper left and upper right corner portions of a strap device 12, which will be described later, can be fixed to the pair of upper left and upper right corner portions of the second enclosure 3 with screws.

As shown in FIGS. 12 and 13, hook portions 11 are formed on a pair of lower left and lower right corner portions of the second enclosure 3. Thus, a pair of lower left and lower right corner portions of the belt base 13 of the strap device 12, which will be described later, can be attached to the pair of lower left and lower right corner portions of the second enclosure 3.

It should be noted that, in the electronic apparatus body 1, the circuit board (not shown) equipped with a signal processing circuit for processing an input signal received from the key input portion 5 or the like or a display signal to be displayed on the liquid crystal display portion 4 is disposed.

Strap Device

Figure 4:
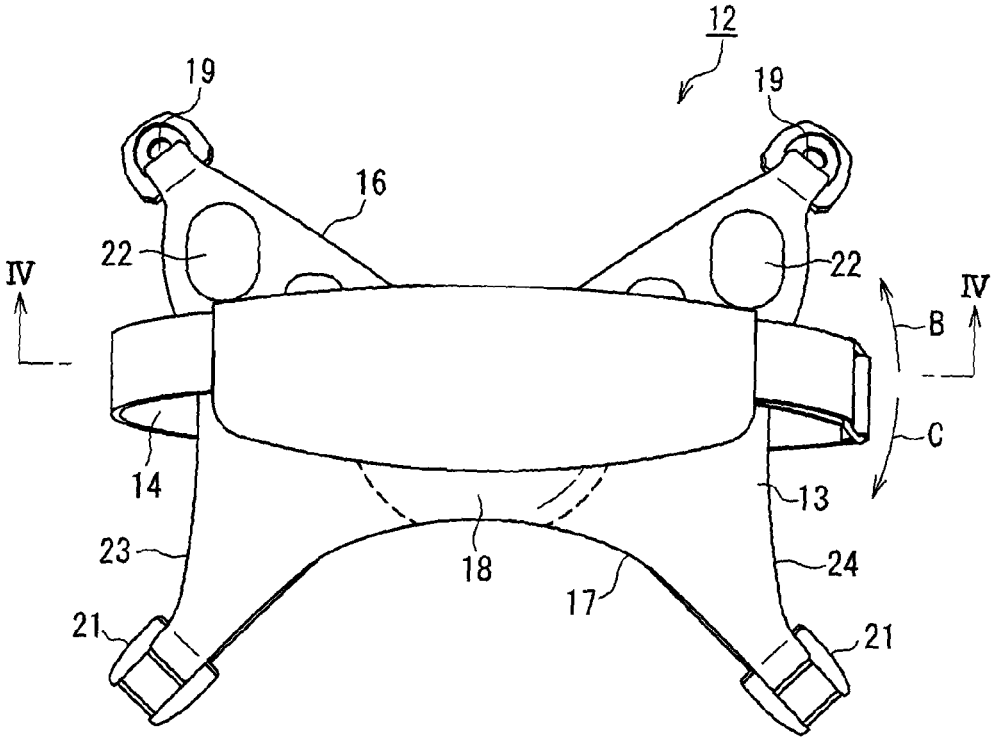
FIG. 4 is a front view showing a strap device according to Embodiment 2 of the present invention.
Figure 5:
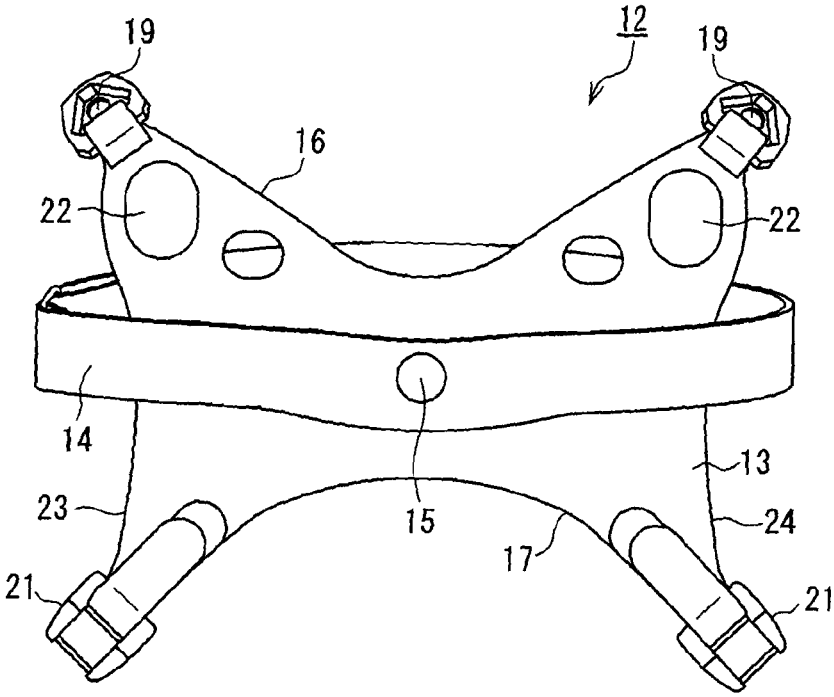
FIG. 5 is a back view showing the strap device according to Embodiment 2 of the present invention.
Figure 6:
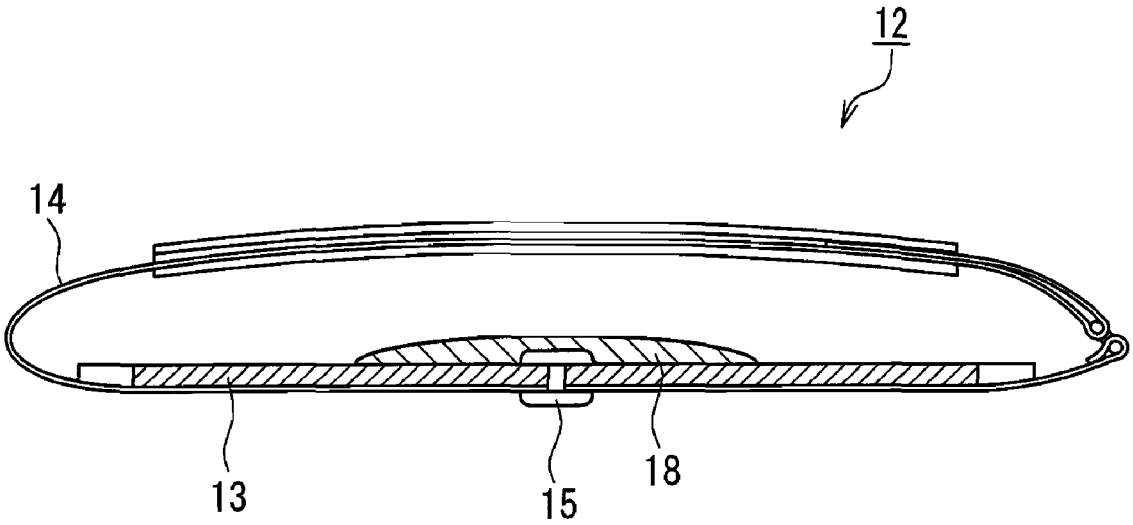
FIG. 6 is a cross-sectional view along the IV-IV line in FIG. 4.
Figure 7:
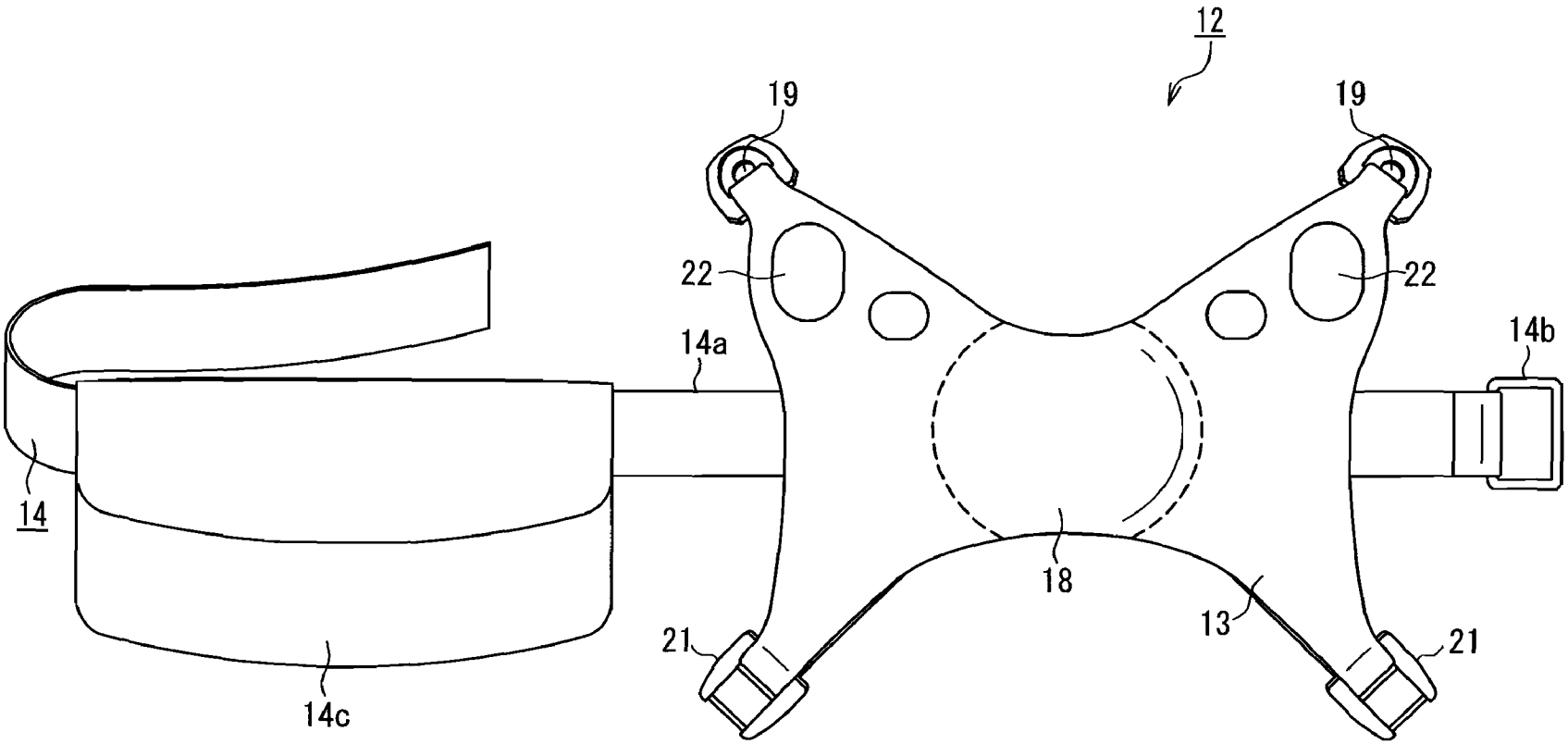
FIG. 7 is a front view showing the strap device according to Embodiment 2 of the present invention in a state where a strap belt is open.
Figure 8:
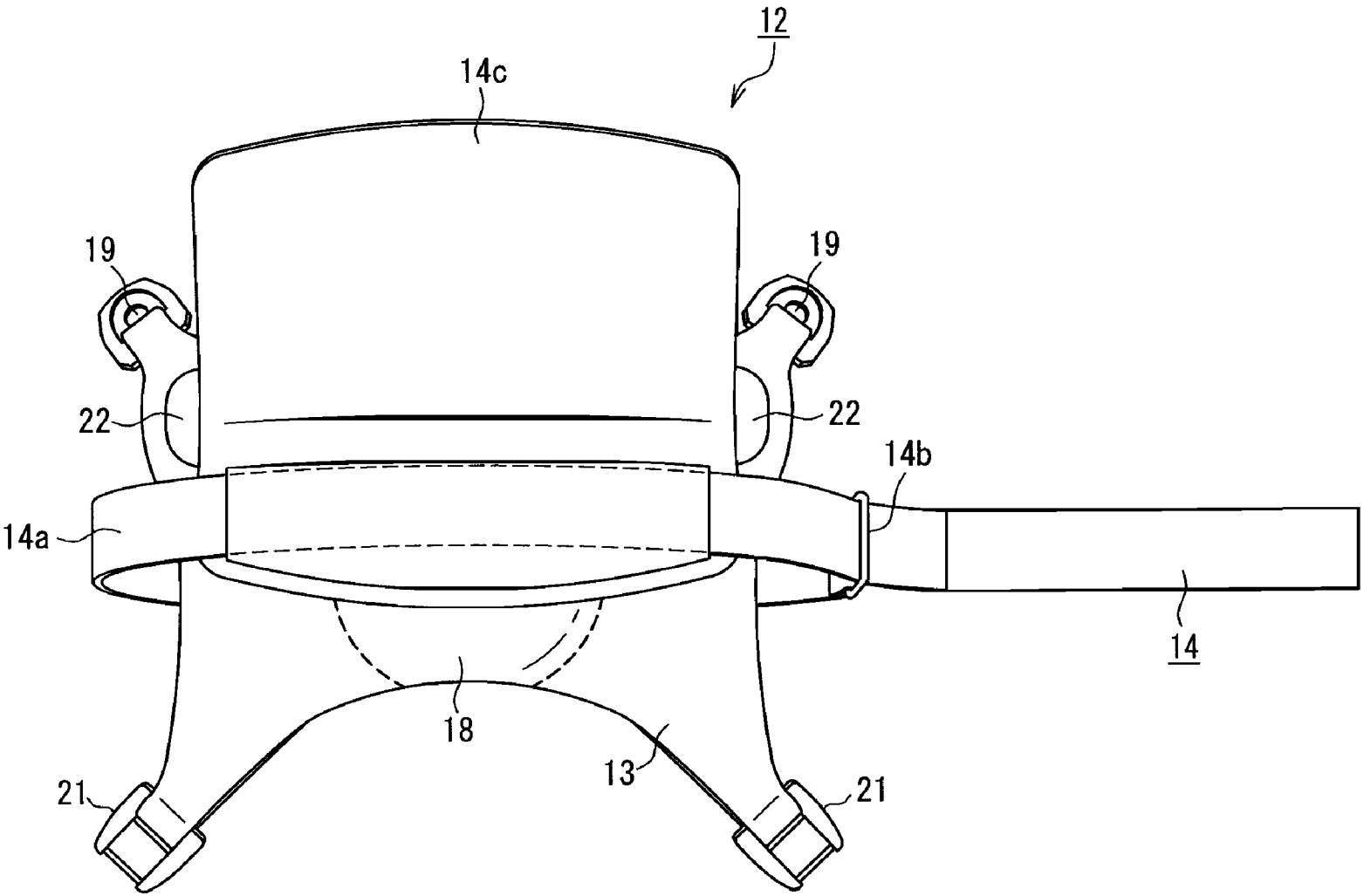
FIG. 8 is a front view showing the strap device according to Embodiment 2 of the present invention for describing how to adjust the length of the strap belt.
Figure 9:
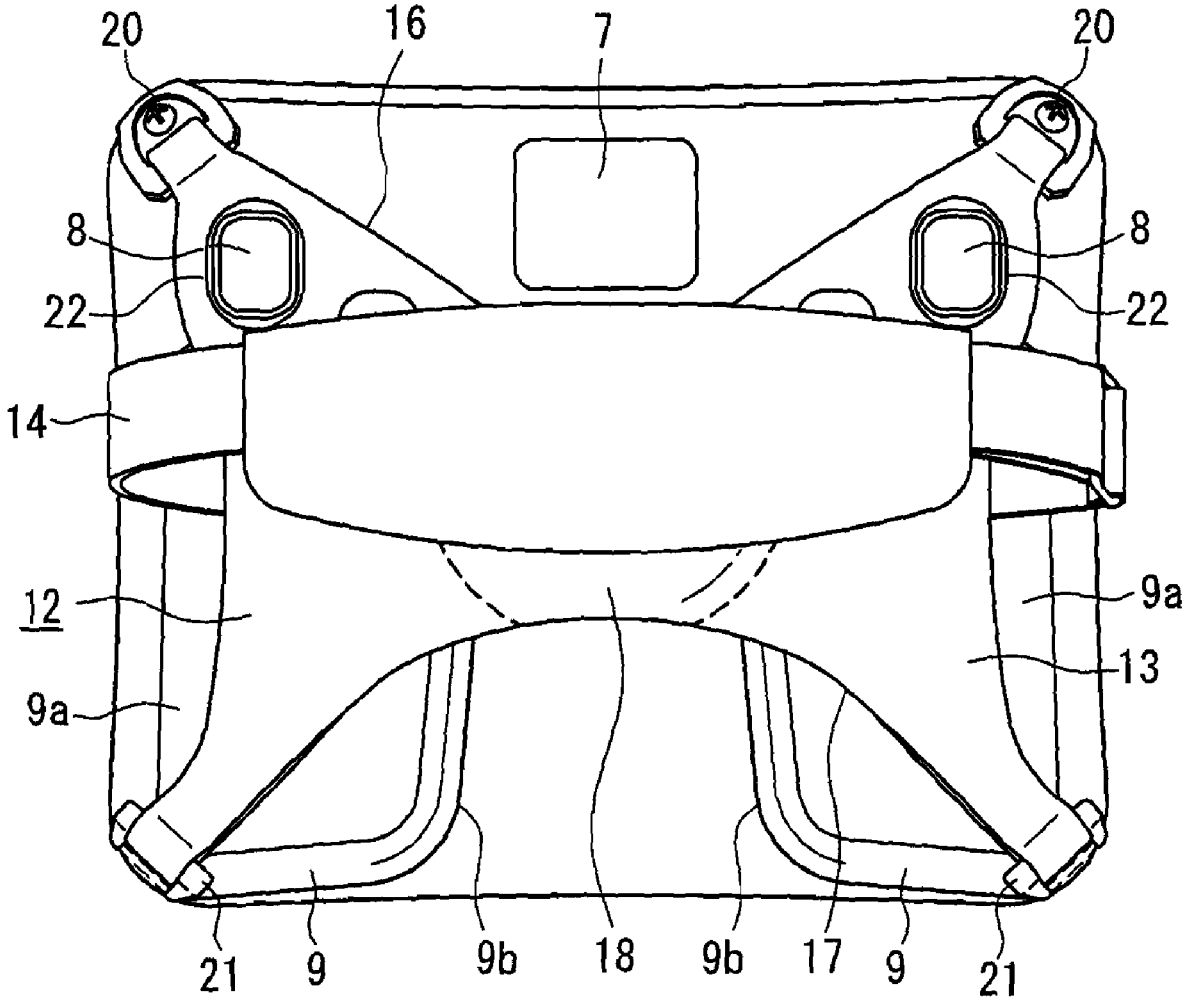
FIG. 9 is a front view showing the strap device according to Embodiment 2 of the present invention attached to the back of an electronic apparatus body.

Next, the strap device according to the present embodiment will be described. FIG. 4 is a front view showing the strap device according to Embodiment 2 of the present invention. FIG. 5 is a back view showing the strap device according to Embodiment 2 of the present invention. FIG. 6 is a cross-sectional view along the IV-IV line in FIG. 4. FIG. 7 is a front view showing the strap device according to Embodiment 2 of the present invention in a state where the strap belt is open. FIG. 8 is a front view showing the strap device according to Embodiment 2 of the present invention, for describing how to adjust the length of the strap belt. FIG. 9 is a front view showing the strap device according to Embodiment 2 of the present invention attached to the back of the electronic apparatus body.

As shown in FIGS. 4 to 6, a strap device 12 according to the present embodiment includes: a substantially plate-shaped belt base 13 to be attached to an object; and a strap belt 14 formed in an annular shape and supported by a substantially center portion of the belt base 13 rotatably within a plane substantially parallel to the belt base 13. The belt base 13 is composed of a back part provided with a pivot fitting 15 as a bearing member for supporting the belt base 13 rotatably and a front part facing the back part. The strap belt 14 extends across the belt base 13 from the front part to the back part of the belt base 13. Since the strap device 12 has such a configuration, a part of the annular strap belt 14 positioned on the back side of the belt base 13 is pressed by the belt base 13 when the strap device 12 is attached to, for example, the back of the electronic apparatus body 1 (see FIG. 9), and the shape of the strap belt 14 can be stabilized. It should be noted that the strap belt 14 can be rotated about plus or minus 20° from the state shown in FIG. 4 (see arrows B and C in FIG. 4).

Further, the strap belt 14 projects beyond from each of opposing left and right outer edges of the belt base 13, thereby allowing the rotation movement of the strap belt 14 with respect to the belt base 13.

Further, concave notches 23 and 24 are formed on the left and the right outer edges of the belt base 13, respectively. By adopting such a configuration, the rotation movement of the strap belt 14 with respect to the belt base 13 can be allowed while the strap belt 14 can be downsized.

Notches 16 and 17 are formed on upper and lower outer edges of the belt base 13, respectively. The upper and the lower outer edges couple between the left and the right outer edges from which the strap belt 14 projects. As described above, the camera 7 is provided at the upper center portion of the second enclosure 3 of the electronic apparatus body 1. The upper notch 16 is for preventing the camera 7 from being hidden by the strap device 12 when the strap device 12 is attached to the second enclosure 3 positioned on the back side of the electronic apparatus body 1 (see FIG. 9). Further, as described above, the opposing edge portions 9*b* of the pair of battery packs 9 provided respectively on both the left and the right sides of the second enclosure 3 of the electronic apparatus body 1 are the portions with which the tips of the fingers except thumbs come into contact when the electronic apparatus body 1 is held and operated with both hands. The lower notch 17 is for preventing the edge portions 9*b* from being hidden by the strap device 12 when the strap device 12 is attached to the second enclosure 3 positioned on the back side of the electronic apparatus body 1 (see FIG. 9). Furthermore, elliptic openings 22 are formed on upper left and upper right sides of the belt base 13, respectively. As described above, the elliptic trigger buttons 8 are provided on the upper left and the upper right sides of the second enclosure 3 of the electronic apparatus body 1. The openings 22 are for preventing the trigger buttons 8 from being hidden by the strap device 12 when the strap device 12 is attached to the second enclosure 3 positioned on the back side of the electronic apparatus body 1 (see FIG. 9).

A protrusion 18, which protrudes toward the strap belt 14 side, is provided at a substantially center portion of the front side of the belt base 13. Thus, when a palm is placed through the strap belt 14, the protrusion 18 comes to the dinted portion of the palm (see FIG. 10). By providing the protrusion 18, when placing the palm into the strap belt 14 and holding the electronic apparatus body 1 as the object with the palm, the protrusion 18 fits into the dinted portion of the palm, thereby allowing a user to hold the electronic apparatus body 1 easily without exerting extra force. Thus, the electronic apparatus body 1 can be used comfortably. It is preferable that the protrusion 18 is rounded.

Screw insertion holes 19 as attachment members are provided at a pair of upper left and upper right corner portions of the belt base 13, respectively. Thus, the strap device 12 can be attached to the back side of the electronic apparatus body 1 by placing the screw insertion holes 19 of the belt base 13 over screw holes 10 on the electronic apparatus body 1 side, and fixing the strap device 12 to the electronic apparatus body 1 with screws 20 (see FIG. 9). Further, engagement fittings 21 as attachment members are provided at a pair of lower left and lower right corner portions of the belt base 13, respectively. Thus, when attaching the strap device 12 to the back side of the electronic apparatus body 1, the engagement fittings 21 of the belt base 13 can be engaged with the hook portions 11 (see FIG. 13) on the electronic apparatus body 1 side (see FIG. 9). In this way, the attachment members provided at the pair of lower left and lower right corner portions of the belt base 13 are attachable to and detachable from the electronic apparatus body 1. Thus, replacement of the batteries of the electronic apparatus body 1 can be performed easily by disengaging the engagement fittings 21 provided at the pair of lower left and lower right corner portions of the belt base 13 from the hook portions 11 on the electronic apparatus body 1 side, and removing the lids 9*a* of the battery packs 9.

As shown in FIGS. 7 and 8, the strap belt 14 of the strap device 12 includes: a strip-shaped belt member 14*a* whose midpoint is supported rotatably by the center portion of the back side of the belt base 13; an insertion fitting 14*b* provided at one end portion of the belt member 14*a* and into which the other end portion of the belt member 14*a* is inserted, and a holding and fixing member 14*c* provided on the other end portion side of the belt member 14*a* for holding (sandwiching) and fixing the other end portion of the belt member 14*a* in a state of being inserted in the insertion fitting 14*b*. Here, a pair of hook-and-loop fasteners (not shown) provided at the other end portion of the belt member 14*a* and on the holding and fixing member 14*c* hold and fix the other end portion of the belt member 14*a*. By holding and fixing the other end portion of the belt member 14*a* in the state of being inserted in the insertion fitting 14*b* in the above manner, the strap belt 14 is formed in an annular shape. In this case, by adjusting the length of the other end portion of the belt member 14*a* inserted into the insertion fitting 14*b*, the size of the strap belt 14 in an annular shape can be changed in accordance with the size of a user's hand.

The Use of the Strap Device and the Electronic Apparatus Body Equipped with the Strap Device Next, the use of the strap device and the electronic apparatus body equipped with the strap device according to the present embodiment will be described.

Figure 10:
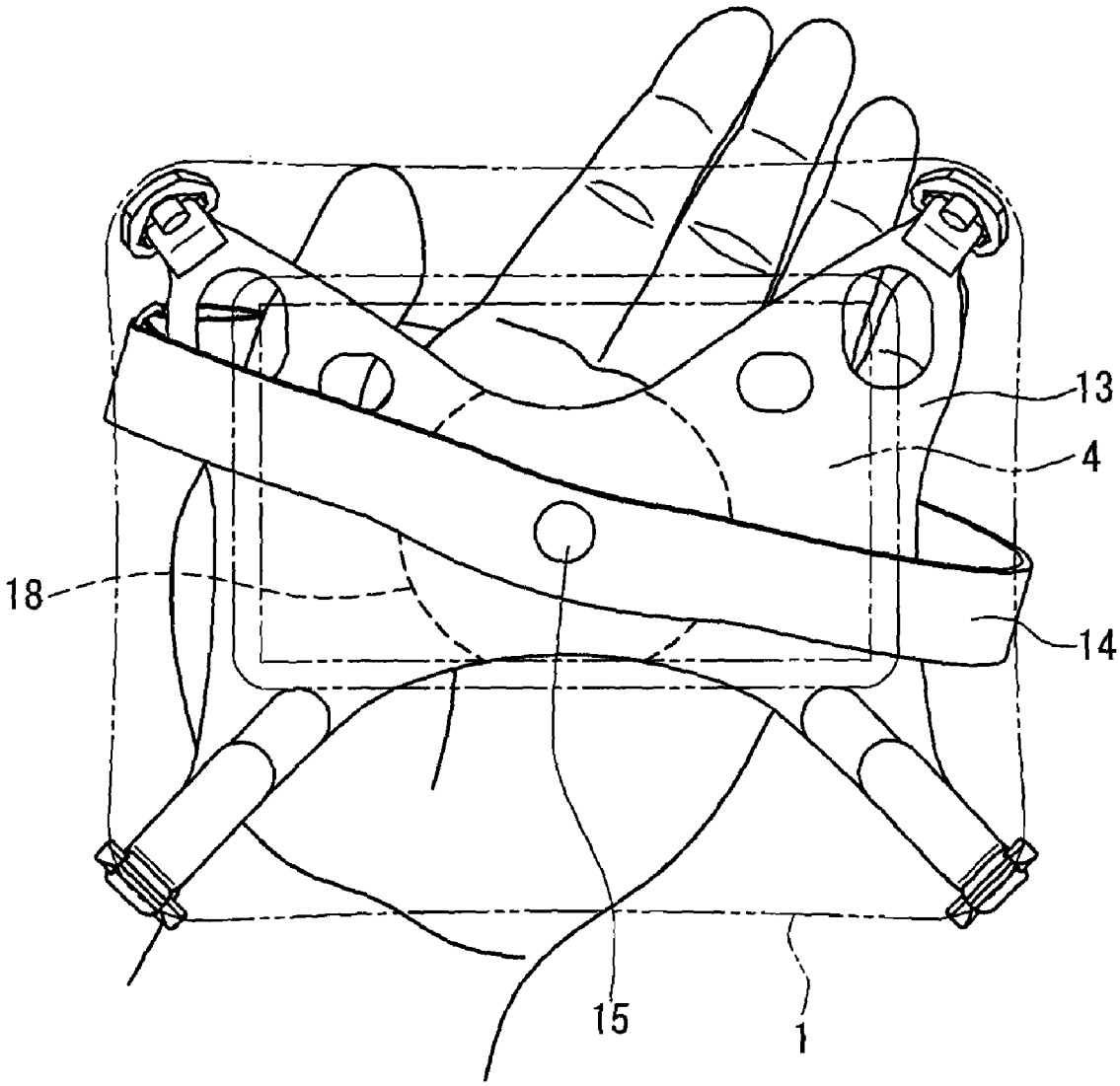
FIG. 10 is a front view showing a condition of use of the electronic apparatus body equipped with the strap device according to Embodiment 2 of the present invention.

FIG. 10 is a front view showing a condition of use of the electronic apparatus body equipped with the strap device according to Embodiment 2 of the present invention.

The strap device 12 according to the present embodiment is used in a state of being attached to the back side of the electronic apparatus body 1 (see FIG. 9). The strap device 12 is attached to the electronic apparatus body 1 as follows. First, the screw insertion holes 19 at the pair of upper left and upper right corner portions of the belt base 13 are placed over the screw holes 10 on the electronic apparatus body 1 side, and the strap device 12 is fixed to the electronic apparatus body 1 with the screws 20. Then, the engagement fittings 21 provided at the pair of lower left and lower right corner portions of the belt base 13 are engaged with the hook portions 11 on the electronic apparatus body 1 side. After attaching the strap device 12 to the electronic apparatus body 1 in the above manner, the left hand is placed through the strap belt 14 and the electronic apparatus body 1 is held with the palm of the left hand while the first input keys 5*a* are operated with the right hand. In this case, the strap belt 14, through which the palm of the left hand is placed, is supported by the substantially center portion of the belt base 13 attached to the electronic apparatus body 1 rotatably within a plane substantially parallel to the belt base 13. Thus, as shown in FIG. 10, the visibility of the liquid crystal display portion 4 and the operability of the key input portion 5 and the touch panel can be improved by rotating the electronic apparatus body 1 without having to tilt the electronic apparatus body 1 with the wrist. As a result, even if the electronic apparatus body 1 is used for long hours by holding it with the left hand, the wrist does not get tired. Further, since the strap belt 14 can be rotated clockwise and counterclockwise with respect to the belt base 13 (the electronic apparatus body 1), both a right-handed user and a left-handed user can obtain similar effects by using the strap device 12. Further, as described above, since the electronic apparatus according to the present embodiment is easy to hold and has excellent operability, it is possible to reduce the chances of the electronic apparatus body 1 held with the palm placed through the strap belt being dropped. Consequently, it is possible to reduce breakdown of the electronic apparatus body 1 or to reduce the chances of the user himself or people in the surroundings being injured as a result of dropping the electronic apparatus body 1.

In the strap device 12 according to the present embodiment, the concave notches 23 and 24 are formed at the left and the right outer edges of the belt base 13. However, these concave notches 23 and 24 are not absolute necessities.

Further, in the strap device 12 according to the present embodiment, the notches 16 and 17 are formed respectively at the upper and the lower outer edges of the belt base 13 coupling between the left and the right outer edges from which the strap belt 14 projects. The notch needs to be formed on at least the upper or the lower outer edge. Further, when a camera or the like is not provided on the back side of the electronic apparatus body as an object, it is not necessary to form the notches at the upper and the lower outer edges of the belt base.

Further, the strap device 12 according to the present embodiment includes the protrusion 18 that comes to the dinted portion of a palm when the palm is placed through the strap belt. However, the protrusion 18 is not an absolute necessity.

Further, in the strap device 12 according to the present embodiment, the belt base 13 is composed of the back part provided with the pivot fitting 15 as a bearing member for supporting the strap belt 14 rotatably; and a front part facing the back part, and the strap belt 14 extends across the belt base 13 from the front part to the back part of the belt base 13. However, the strap device 12 is not necessarily limited to such a configuration. For example, the annular strap belt may be placed on the front side of the belt base and may be supported by the front side of the belt base. In this case, the protrusion, which comes to the dinted portion of a palm when the palm is placed through the strap belt, is provided to the strap belt as needed.

Further, in the strap device 12 according to the present embodiment, only the attachment members on the pair of lower left and lower right corner portions of the belt base 13 are attachable to and detachable from the object (the electronic apparatus body 1). It is useful for the attachment members on at least either the pair of upper left and upper right corner portions or the pair of lower left and lower right corner portions of the belt base to be attachable to and detachable from the object. However, when the electronic apparatus body as the object is not provided with the battery packs including replaceable lids on the back side, none of the attachment members at the corner portions of the belt base may need to be attachable to and detachable from the object.

It should be noted that the attachment members at the respective corner portions of the belt base do not need to be provided at the positions that coincide with the respective corner portions of the second enclosure of the electronic apparatus body. If a user can hold the electronic apparatus body, the area of the belt base may be smaller than that of the back side of the second enclosure.

Though the embodiments described above refer to examples of a notebook PC and a PDA, the strap device of the present invention can be widely applied to, for example, a game machine, a portable navigation system, or a terminal used in nursing for collecting patients' day-to-day data and transmitting it to a host computer.

As described above, according to the present invention, it is possible to provide a strap device capable of, when used in a state of being attached to an electronic apparatus body including a display portion and a key input portion as the object, improving the visibility of the display portion and the operability of the key input portion or the touch panel without tilting the electronic apparatus body with the wrist. Thus, the present invention is useful as a strap device for improving the portability of an electronic apparatus with excellent portability such as a notebook PC, a PDA, a game machine, or a terminal used in nursing.

The invention may be embodied in other forms without departing from the sprit of essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A strap device comprising:

a substantially plate-shaped belt base to be attached to an object, the belt base including:

a back part provided with and fixed to a bearing member for rotatably supporting a hand strap belt, the bearing member passing through and fixed to the hand strap belt, and a front part facing the back part; and the hand strap belt formed in an annular shape so as to extend across the belt base from the front part to the back part of the belt base and supported by a substantially center portion of the belt base rotatably within a plane substantially parallel to the belt base such that the hand strap belt is rotatable relative to the belt base through the bearing member, wherein the hand strap belt is configured such that a hand simultaneously contacts both a portion of the belt base and a base portion of the hand strap belt, and wherein the hand strap belt includes a single strip-shaped belt member having two ends, the strip-shaped belt member being formed in an annular shape by adjustably fixing both ends of the strip-shaped belt member.

2. The strap device according to claim 1, wherein the belt base includes opposing left and right outer edges, an upper outer edge and a lower outer edge, and wherein the hand strap belt projects beyond each of the opposing left and right outer edges of the belt base, and a notch is formed on at least either of the upper and lower outer edges of the base belt coupling the left and the right outer edges from which the hand strap belt projects.

3. The strap device according to claim 2, wherein a concave notch is formed on each of the left and the right outer edges of the belt base.

4. The strap device according to claim 1, wherein a protrusion protruding toward the hand strap belt side is provided at a substantially center portion of the front part of the belt base.

5. The strap device according to claim 4, wherein the protrusion is rounded.

6. The strap device according to claim 1, wherein the belt base includes a plurality of outer edges and a plurality of corner portions and wherein each corner portion is provided with an attachment member for attaching the belt base to the object.

7. The strap device according to claim 6, wherein the attachment members provided at least either a pair of upper left and upper right corner portions or a pair of lower left and lower right corner portions are attachable to and detachable from the object.

8. An electronic apparatus comprising:

an electronic apparatus body including a first enclosure including a control portion for controlling a display signal to be displayed on a display portion, a circuit board equipped with a signal processing circuit for processing an input signal received from the control portion and/or a display signal to be displayed on the display portion, and a second enclosure containing the circuit board and forming a housing together with the first enclosure; and the strap device according to claim 1 attached to the second enclosure.

9. The electronic apparatus according to claim 8, wherein the display portion and the control portion are provided in the same plane of the first enclosure.

* * * * *